US005269462A

United States Patent [19]

Suzon et al.

[11] Patent Number: 5,269,462

[45] Date of Patent: Dec. 14, 1993

[54] PROCESS AND APPARATUS FOR THE FORMATION OF A DEPOSIT BY PROJECTION OF A COATING MATERIAL ON A SUBSTRATE

[75] Inventors: Serge Suzon, Pontoise; Richard Soula, Jouy le Moutier; Michel Arnout, Lyons, all of France

[73] Assignees: l'Air Liquide, Societe Anonyme pour l'Etude et l'Exploitation des Procedes Georges Claude; La Soudure Autogene Francaise, both of Paris, France

[21] Appl. No.: 872,012

[22] Filed: Apr. 22, 1992

[30] Foreign Application Priority Data

Apr. 25, 1991 [FR] France ..... 91 05081

[51] Int. Cl.[5] ..... B05B 1/14; B05C 5/04

[52] U.S. Cl. ..... 239/83; 239/552; 239/558

[58] Field of Search ..... 239/79, 83, 84, 552, 239/558

[56] References Cited

U.S. PATENT DOCUMENTS

| | | | |
|---|---|---|---|
| 2,340,903 | 2/1944 | Shepard | 239/83 |
| 2,832,640 | 4/1958 | Shepard | 239/84 |
| 3,526,366 | 9/1970 | Rothrock | 239/552 X |
| 5,186,620 | 2/1993 | Hollingshead | 239/558 |

FOREIGN PATENT DOCUMENTS

| | | | |
|---|---|---|---|
| 71361 | 10/1942 | Czechoslovakia | 239/83 |
| 0017944 | 10/1980 | European Pat. Off. . | |
| 0323185 | 7/1989 | European Pat. Off. . | |
| 0361710 | 4/1990 | European Pat. Off. . | |
| 0379119 | 7/1990 | European Pat. Off. . | |
| 250665 | 7/1948 | Switzerland | 239/83 |

OTHER PUBLICATIONS

"Wire-Fed Thermal Spraying-What the Designer Should Know," Design Engineering, Jul. 1982, pp. 51, 54 and 57.

*Primary Examiner*—Andres Kashnikow
*Assistant Examiner*—William Grant
*Attorney, Agent, or Firm*—Curtis, Morris & Safford

[57] ABSTRACT

A projection device for depositing by projection a fused coating material onto a substrate. The projection device includes a projection nozzle having a central part defining a central passage for the coating material to be fused and projected. The central passage opening at a distal end thereof into a central orifice. The central part being fitted in a peripheral part. Ejection openings of ducts of oxycombustible mixture being distributed around the central orifice according to at least two series which are alternatingly offset from one another with respect to a main axis of the nozzle. The ducts include channels which are milled in the periphery of the central part. The carrier gas contains between 1 and 10% oxygen with the remaining portion consisting of nitrogen. The carrier gas being supplied by a unit for the separation of inert gas from air by adsorption or permeation. The projection device is particularly suited for the formation of the anti-corrosive deposits based on zinc.

9 Claims, 2 Drawing Sheets

PROCESS AND APPARATUS FOR THE FORMATION OF A DEPOSIT BY PROJECTION OF A COATING MATERIAL ON A SUBSTRATE

BACKGROUND OF INVENTION a) Field of the Invention

The present invention concerns a process for the formation of a deposit by projection of a coating material on a substrate, comprising the steps of melting, by combustion of an oxycombustible mixture, the solid coating material and pulverizing and projecting the molten coating material by means of a flow of a carrier gas containing at least 90% of at least one inert gas.

b) Description of Prior Art

The thermal projection with a flame, combines a whole group of processes in order to modify the surface properties of a substrate by providing, on this surface, a deposit of a coating material, which is generally metallic. Through the combustion of the oxycombustible mixture, the coating material is progressively brought to its melting temperature and the carrier gas pulverizes the molten material into fine particles which are provided with a strong kinetic energy. The particles in liquid or pasty state hit the substrate which is initially prepared for this operation. The carrier gas actually used consists of compressed air and the yields (ratio between the weight of the coating material truly deposited on the substrate and the weight of the coating material effectively used) typically obtained, are of the order of 55 to 57% for the projection of zinc which is the metal most currently used for the production of anticorrosive deposits, such as on metallic tubes.

The Applicant has noted that the thermodynamic properties of the carrier gas play an important role on the value of the yield. Thus, the vaporization temperature of the coating material may be rapidly reached for particles of small diameter if the carrier gas has a high thermic conductivity. On the other hand, the formation of oxides on the particles during their travel between the melting zone and the substrate to be coated is exothermic and may thus lead to an excessive evaporation of the material to be projected.

SUMMARY OF INVENTION

It is a first object of the present invention to propose a process of the type mentioned above, which is easy to carry out and is flexible, enabling a notable improvement of the projection yield and which may be carried out with reduced operation cost.

For this purpose, according to a more specific characteristic of the invention, the carrier gas comprises between 1 and 10% oxygen, typically between 2 and 8%, the remainder being nitrogen, this carrier gas being typically supplied by a unit for the separation of air by adsorption or permeation.

According to this aspect of the invention, the carrier gas may be produced at low costs and, although a small quantity of oxygen remains present, the increase of the yield may reach 13%, for the projection of zinc. Such a carrier gas with a high proportion of inert gas enables indeed to decrease the reactivity of the medium along the path followed by the particles because of the reduction of the oxidation zone and therefore enables a reduction of the volume of coating material which is in combustion and a decrease of the quantity of oxidized particles which are unsuitable for good linking on the substrate. Moreover, the reduction of the volume of heat following a decrease of the volume of oxidized particles reduces the distance between the projection nozzle and the substrate without modifying the quality of the deposit, and therefore enhances concentration of the projection.

In the known processes, the combustible gas consists essentially of propane and sometimes acetylene. In the case of propane, the oxycombustible mixture has a low specific power and combustion speed the flame obtained forming long tips and being overall too powerful. The increase of the volume of oxygen, to raise the specific power, or the increase of the overall flow of oxycombustible mixture only reduces the projection yield. On the other hand, acetylene has a high specific power and combustion speed resulting in short tips and a flame which is locally too powerful. The reduction of the amount of oxygen or of the overall flow oxycombustible mixture produces a substantial decrease of the rate of deposit.

It is another object of the present invention to propose a process which is still improved by the use of performing gases which are better adapted and by an optimization of the distribution of the heating of the coating material to be melted.

According to an aspect of the invention, the oxycombustible mixture is prepared by adding oxygen and a compound of propylene and methylacetylene, or a compound of ethylene and acetylene.

These compounds, which are commercially available, have a specific power, a combustion speed and a length of tip which are intermediate between those of propane and acetylene. The flame obtained results in a better distribution of the calorific power around the wire of the coating material.

According to another characteristic of the invention, the oxycombustible mixture is ejected towards the coating material along at least two series of ejection ducts which are radially offset with respect to the latter.

It is still another object of the present invention to propose an improved projection device at low manufacturing costs which is particularly suitable for carrying out the processes defined above, comprising a projection nozzle having a main axis and including a central duct for supplying coating material, which opens through an orifice at one end of the nozzle, a plurality of ducts of oxycombustible material opening at the end of the nozzle by means of openings which are angularly distributed around the central orifice, and an annular duct for carrier gas surrounding the end of the nozzle, characterized in that the openings of the ducts of oxycombustible mixture are distributed according to at least two series which are offset from one another relative to the main axis.

The known flame projection nozzles are monobloc and the mixture ducts consist of tubular passages bored in the nozzle and terminating into calibrated orifices of the same diameter which are distributed along a circle around the central orifice, according to an arrangement which is hard to produce and permits only a reduced number of adaptations.

According to an aspect of the invention, the nozzle comprises a central part defining the central ducts and fitted in a tubular peripheral part, the mixing ducts being formed at the interface between the central and peripheral parts and emerging through openings which are distributed in at least a first and a second series, the distance between the main axis and the openings of the first series being larger than the distance between the openings of the second series and the main axis. The mixture ducts are advantageously formed by means of longitudinal channels which are milled in the periphery of the central part, which easily modulates the depth, the shape and the number of these mixing ducts, and to reduce the manufacturing costs. Such a projecting device has also been found to be more efficient and flexible in use than the known devices which use known gases, namely air as carrier gas and acetylene or propane as combustible gas.

BRIEF DESCRIPTION OF DRAWINGS

Other characteristics and advantages of the present invention will appear form the description which follows of embodiments given by way of illustration but without limitation, with reference to the annexed drawings, in which.

DESCRIPTION OF PREFERRED EMBODIMENTS

Figure 1:
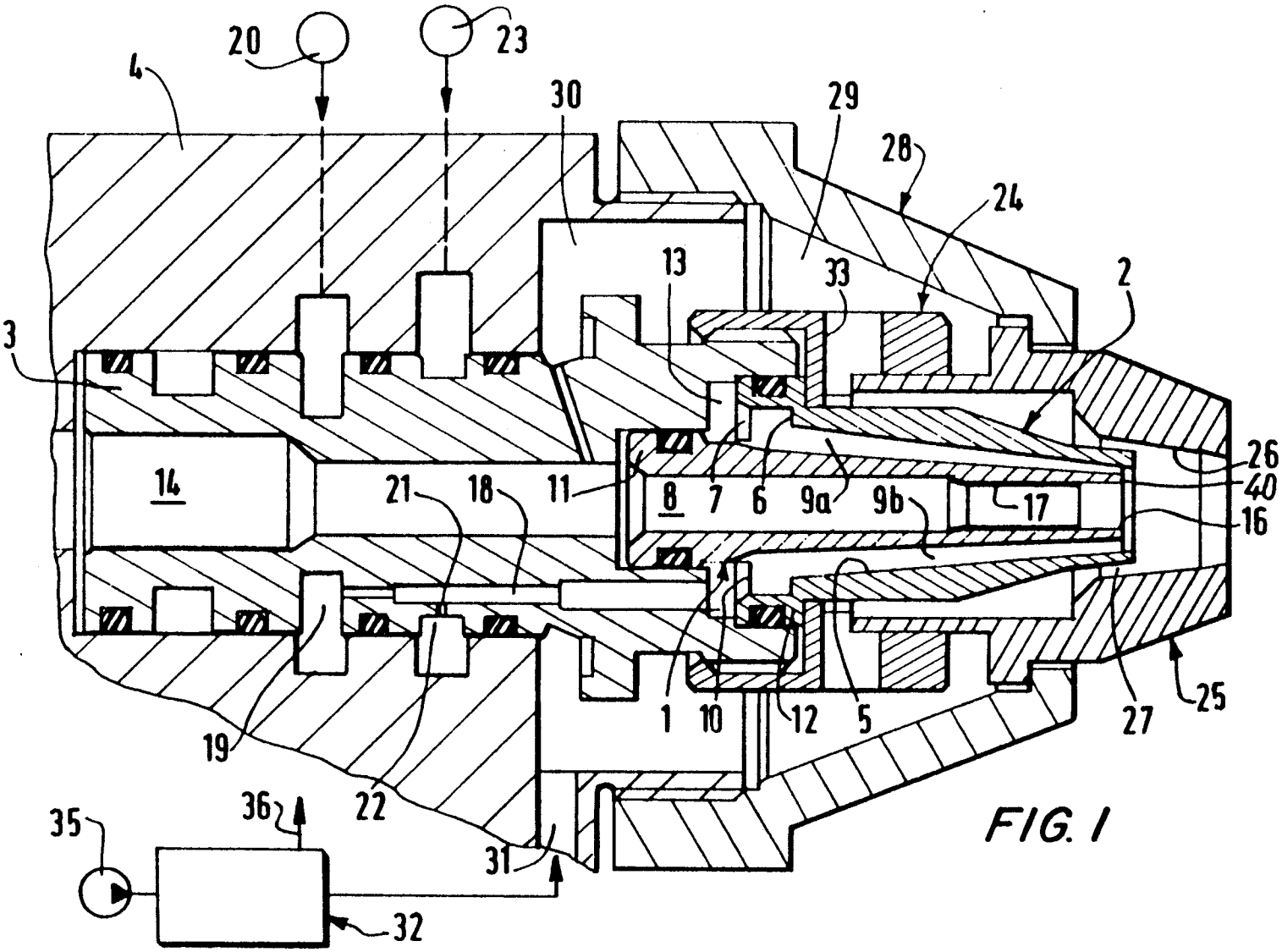
FIG. 1 is a schematic view in longitudinal cross-section of a projection device according to the invention.
Figure 2D:
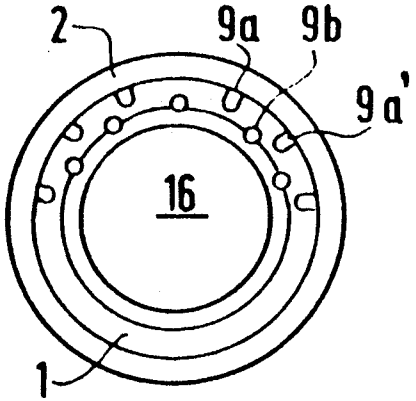
FIGS. 2(*a*)-(*d*) represent, viewed from one end of the projection nozzle, various embodiments of ducts of oxycombustible mixture.
Figure 2C:
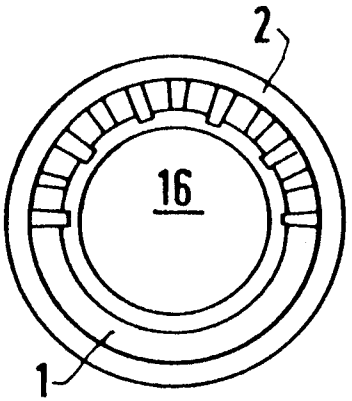
Figure 2B:
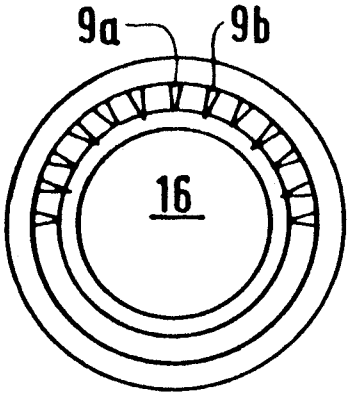
Figure 2A:
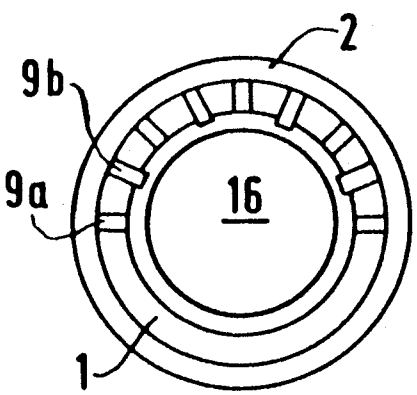

FIG. 1 shows a projection nozzle consisting of a coaxial assembly of a central tubular part 1 mounted in a tubular peripheral part 2, this assembly being mounted coaxially in an end of a cylindrical support 3 which itself is mounted in a body 4 of a projection gun. In the embodiment illustrated in FIG. 1, the peripheral part 2 includes a central truncated central bore passage 5 connecting, at the rear, by means of a radial shoulder 6, to an annular chamber 7 of widened diameter. The central part 1 includes a central passage duct 8 and includes, at its periphery, two series of longitudinal channels 9*a* 9*b* of different depths, which alternate and are angularly distributed. The outside profile of the ribbed portion of the central part 1 substantially corresponds to the inner profile 5 of the peripheral part 2. In particular, the ribs between the channels 9*a*, 9*b* include a rear part of enlarged diameter 10 which is received in annular chamber 7, abutting the radial shoulder 6 but not extending on the entire axial extension of the annular chamber 7. The central part 1 includes a rear end 11 of reduced diameter while the peripheral part 2 includes a rear end 12 of widened diameter, these rear ends being received in a stepped front housing 13 of support 3 in which there is a central passage 14 through which the coating material, in the form of homogeneous or compacted wire 15, associated with pulling means (not illustrated), moves in central duct 8 of the central member 1 to exit, at the front end of the nozzle, through a central opening 16, around which emerge the ducts 9A, 9B (FIG. 2). The duct 8 advantageously includes, in the vicinity of central orifice 16, a tubular lining 40 made of a material which is more resistant to wear, for example stainless steel. The tubular support 3 includes a plurality of longitudinally stepped ducts 18 emerging, at the downstream end, in the downstream end of enlarged diameter of the stepped housing 13 and, at the upstream end, in an annular chamber 19 which communicates, via ducts provided in body 4, with a source of combustible gas 20, typically a compound of propylene and methylacetylene which is sold under the designation "TETRENE" or a compound of ethylene and acetylene which is sold under the designation "CRYLENE". The median portion of intermediate diameter in each duct 18 communicates, by means of a radial duct 21, with an annular chamber 22 which itself communicates, via internal ducts provided in body 4, with a source of oxygen 23. The oxycombustible mixture is formed in ducts 18 and is homogeneously distributed in the annular chambers 13 and 7 to feed, also in homogenous manner, the ducts 9*a*, 9*b*.

The combination of the central nozzle part 1 and peripheral nozzle part 2 is mounted and held against an internal shoulder of the housing 13 by means of a bolt 24 screwed on the front end of the support 3. In the front part of the bolt 24 there is provided an end sleeve 25 which surrounds the peripheral part 2 and defines an internal housing which ends, at the front, into a converging conical part 26 which surrounds the front end of the peripheral part 2 by providing, around the latter, an annular duct 27. Sleeve 25 is held and blocked into position in bolt 24 by means of a peripheral hood 28 screwed on the front end of body 4 by thus forming an annular chamber 29 around bolt 24 and the rear part of the sleeve 25. The front end of body 4 includes an annular chamber 30 which communicates, through an interior passage 31, with a source of carrier gas 32. Sleeve 24 includes radial ducts 33 establishing communication between chamber 29 provided in hood 28 and the annular space between the sleeve 25 and the peripheral nozzle part 2. The carrier gas from source 32 is uniformly distributed in annular chamber 30 and passes into the annular chamber 29 while cooling bolt 24 and the rear part of sleeve 25, and from there, through ducts 33, into the annular chamber between the sleeve 25 and the peripheral part 2 towards the exit passage 26, while cooling the peripheral nozzle part 2.

Figure 3:
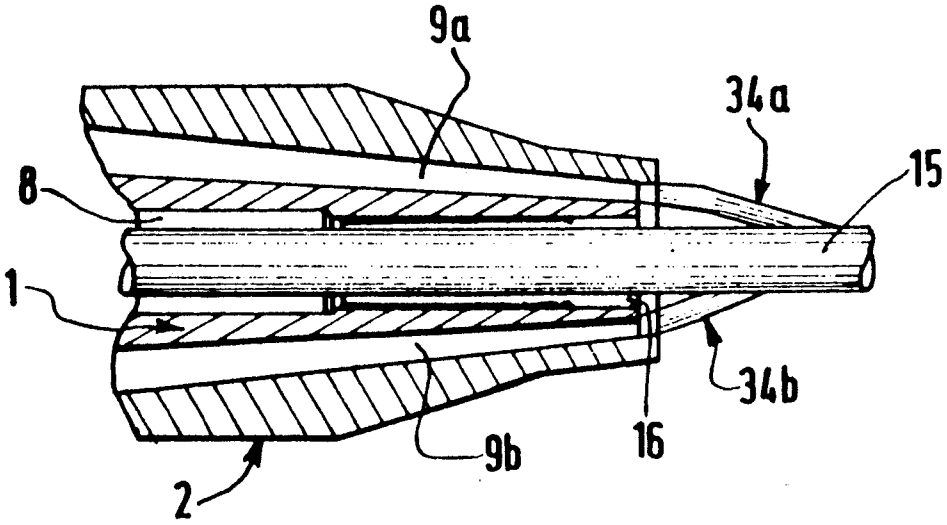
FIG. 3 is a schematic view of the end of the nozzle showing the stepped arrangement of the flames for heating the coating material.

As better illustrated in FIG. 3, the design of the nozzle according to the invention obtains a stepped heating, the alternation of the mixing ducts 9*a*, 9*b* to differently distribute the combustion tips 34*a*, 34*b* around the material to be molten 15. Ducts 9*b* which are closer to the axis of the nozzle, provide a strong heating 34*b* of the material to be molten at a short distance from the front face of the nozzle and produce a rapid temperature rise of the material 15. The other ducts 9*a* ensures a heating 34*a* which is more remote from the end of the nozzle and contribute to a progressive temperature rise of the material to be molten 15.

The design of the nozzle in two parts produces ducts of very different shapes, for example, as illustrated from left to right in FIG. 2, channels of rectangular, triangular or trapezoidal cross-sections. The ease of machining also increases the number of ducts and their angular distribution, and to thus improve the distribution of the heating on the material to be molten. It it thus also possible, as illustrated at the right of FIG. 2, to produce ducts by means of a combination of bored holes 9*b* and channels of various depths 9*a*, 9*a*'.

As mentioned above, the source of carrier gas 32 may consist of a storage of nitrogen or argon or a mixture of both. Advantageously, according to the invention, this source of carrier gas 32 consists of a unit for the separation of the gases from air by adsorption or permeation which is supplied with atmospheric air by means of a compressor 35, the permeate, which is made of oxygen enriched air, being evacuated at 36.

By way of example, for the formation of an anti-corrosive deposit by projection of zinc, with a carrier gas consisting of 97% nitrogen and 3% oxygen and a projection of metal with a mass flow of about 20 kg/hour, the parameters are the following:

carrier gas:
pressure: $4.5-5\times10^5$ Pa
projection flow: 20–30 $m^3$/hour
oxygen: pressure: $2-3\times10^5$ Pa
combustible gas:
flow: 1000–1200 liters/hour
pressure:
compound "CRYLENE": $2\times10^5$ Pa
compound "TETRENE": $2.5\times10^5$ Pa.

Under these conditions, the projection yield, for zinc, is improved by about 9% as compared to the utilization of propane and compressed air.

Although the present invention has been described with respect to specific embodiments, it is not limited thereto, but, on the contrary, is capable of modifications and variants which will appear to one skilled in the art.

We claim:

1. A projection device for depositing by projection a fused coating material onto a substrate, comprising a nozzle having a main axis and including:

a central part defining a central passage for the coating material to be fused and projected, the central passage coaxial to the main axis and opening, at a distal end of the central part, into a central orifice;

an intermediate part having a profiled inner recess coaxial to the main axis and into which is received at least the distal end of the central part;

passage means between the central part and intermediate part defining at least a first and a second series of gas passages for an oxycombustible gas mixture, whereby each of said gas passages is formed in part by said central part and in part by said intermediate part, said passage means having discharge openings arranged in an annular pattern concentrically around the central orifice, the passages of the first series being alternatingly, angularly offset from the passages of the second series, the openings of the passages of the first series having an inner radial end arranged along a first radial pattern coaxial to the main axis, the openings of the passages of the second series having an inner radial end arranged along a second radial pattern coaxial to the main axis and with one of said radial patterns formed radially closer to said main axis than the other radial pattern;

and a sleeve arranged coaxially around said intermediate part and defining therewith an annular gas passage for a carrier gas.

2. The device of claim 1, wherein said passage means further comprises angularly spaced longitudinal vanes arranged between the intermediate part and at least the distal end of the central part, said vane defining therebetween said gas passages.

3. The device of claim 2, wherein the inner recess of the intermediate part has a frustoconical shape and wherein the vanes are integral with the central part and have an outer contour substantially mating with the shape of the inner recess.

4. The device of claim 2, wherein at least the discharge openings of at least one series of said first and second series of gas passages have a cross-section decreasing inwardly.

5. The device of claim 1, wherein the carrier gas is a gas mixture containing not less than 90% of an inert gas.

6. The device of claim 5, wherein the carrier gas contains at least 1% oxygen.

7. The device of claim 6, further comprising a source of said carrier gas, said source comprising an inert gas production unit for the separation of said inert gas from atmospheric air by adsorption or permeation, said atmospheric air being supplied to said inert gas production unit by a compressor.

8. The device of claim 5, wherein the oxycombustible gas mixture is a mixture of oxygen, propylene and methylacetylene.

9. The device of claim 5, wherein the coating material is supplied by a metal wire advanced within the central passage of the central part.

* * * * *